United States Patent [19]

Saito et al.

[11] Patent Number: 4,539,289

[45] Date of Patent: Sep. 3, 1985

[54] SILVER HALIDE LIGHT-SENSITIVE MATERIAL

[75] Inventors: Tsutomu Saito; Keiji Mihayashi, both of Kanagawa, Japan

[73] Assignee: Fuji Photo Film Co., Ltd., Kanagawa, Japan

[21] Appl. No.: 585,692

[22] Filed: Mar. 2, 1984

[30] Foreign Application Priority Data

Mar. 2, 1983 [JP] Japan ..... 58-35177

[51] Int. Cl.[3] ..... G03C 1/46; G03C 1/08

[52] U.S. Cl. ..... 430/506; 430/509

[58] Field of Search ..... 430/506, 509

[56] References Cited

U.S. PATENT DOCUMENTS 3,728,121 4/1973 Zorn et al. ..... 430/509

3,737,317 6/1973 Nicholas et al. ..... 430/509

4,129,446 12/1978 Lohmann et al. ..... 430/506

4,438,194 3/1984 Hamada et al. ..... 430/506

*Primary Examiner*—Mary F. Downey

*Attorney, Agent, or Firm*—Sughrue, Mion, Zinn, Macpeak & Seas

[57] ABSTRACT

A silver halide light-sensitive material is disclosed. The material is comprised of a support comprising thereon at least two emulsion layers having the same color sensitivity and being different light-sensitivities, with a layer containing comparatively light-insensitive silver halide grains of 0.05 to 0.6 μm in average grain size being positioned in at least one of interspaces defined by every two adjacent members of said at least two emulsion layers. The resulting material has both raised sensitivity and improved graininess.

9 Claims, No Drawings

SILVER HALIDE LIGHT-SENSITIVE MATERIAL

FIELD OF THE INVENTION

This invention relates to a silver halide light-sensitive material and, more particularly, to a silver halide light-sensitive material which shows both an improved graininess and a raised sensitivity. More specifically, it relates to the light-sensitive material as described above obtained by employing a novel layer structure.

BACKGROUND OF THE INVENTION

Many techniques have heretofore been known for raising sensitivity of silver halide light-sensitive materials. However, all of them involve such defects as deterioration in graininess of image and increase in fog. Thus, techniques for raising sensitivity without such defects have been desired.

An example of raising sensitivity by devising a new layer structure for the light-sensitive material includes a technique of comprising a fine particle reflecting layer being positioned under and adjacent to an emulsion layer to raise the sensitivity of the emulsion layer by utilizing light-scattering properties of the fine particle reflecting layer. This technique is disclosed in *Research Disclosure* No. 134 (1975), p. 47, 13452.

This technique is surely effective for raising sensitivity, but sometimes it remarkably deteriorates graininess so much that it causes difficult problems when practised.

SUMMARY OF THE INVENTION

An object of the present invention is to eliminate the deterioration in graininess caused by raising sensitivity. That is, a main object of the present invention is to provide a light-sensitive material which shows both a raised sensitivity and an improved graininess.

The above-described object of the present invention is attained by a silver halide light-sensitive material comprising a support comprising thereon at least two emulsion layers having the same color sensitivity and being different in sensitivity, with a layer containing comparatively light-insensitive silver halide grains of 0.05 to 0.6 μm in average grain size being positioned in at least one of interspaces defined by every two adjacent members of said at least two emulsion layers.

DETAILED DESCRIPTION OF THE INVENTION

The layer structure of the present invention raises the sensitivity of the further emulsion layer of the two light-sensitive emulsion layers adjacent to a certain light-insensitive silver halide grains-containing layer from the support and improves graininess of the image for which the two light-sensitive emulsion layers adjacent to the light-insensitive silver halide grain-containing layers are responsible in spite of the increase in sensitivity.

This improvement is entirely unexpected if taking into consideration the fact that, when a comparatively light-insensitive silver halide layer is provided adjacent to and under a least-sensitive emulsion layer, both a raised sensitivity and a deteriorated graininess result.

In the practice of the present invention, the same effects can be obtained both in the case of viewing a silver image as it is and in the case of forming a color image in conformity with the silver image utilizing a coupling reaction or the like.

The light-sensitive material of the present invention preferably contains couplers in emulsion layers. With such light-sensitive materials, one or more emulsion layers having different color sensitivities may be provided for obtaining a color image.

When the layer structure of the present invention is applied to the silver halide light-sensitive material comprising a support comprising thereon at least two emulsion layers having the same color sensitivity and being different in sensitivity with no layer being different in color sensitivity from said at least two emulsion layers being positioned in at least one of interspaces defined in every two adjacent members of said at least two emulsion layers, the effects of the present invention are remarkably obtained. When the layer structure of the present invention is applied to the silver halide light-sensitive color photographic material comprising a support comprising thereon a red-sensitive silver halide emulsion layer unit, a green-sensitive silver halide emulsion layer unit and a blue-sensitive silver halide emulsion layer unit in this order, said every color-sensitive silver halide emulsion layer unit comprising at least two emulsion layers having the same color sensitivity and being different in sensitivity therein, such effects as both an improved graininess and a raised sensitivity are particularly remarkably obtained.

In the present invention, the total number of emulsion layers having the same color sensitivity as that of two emulsion layers adjacent to the comparatively light-insensitive silver halide layer may be two or more, with two or three being preferable. With light-sensitive materials having three or more such emulsion layers, the light-insensitive layer may be provided between every two adjacent emulsion layers (in this case, the number of the light-insensitive silver halide layer being maximum). The objects of the present invention can be attained by providing at least one light-insensitive silver halide layer. A proper number between one and the maximum number of the light-insensitive silver halide layers may be provided based on the architecture of a light-sensitive material.

In the silver halide light-sensitive material comprising a support comprising thereon at least three emulsion layers having the same color sensitivity and being different in sensitivity, when the fine grain reflecting layer is provided adjacent to and under the emulsion layer having the fastest sensitivity of said at least three emulsion layer, such effect as both an improved graininess and raised sensitivity are remarkably obtained.

The light-insensitive emulsion layer is effective to some extent when it contains a coupler. However, when it contains no couplers, a particularly high sensitivity and a good graininess are attained, which is entirely unexpected.

The comparatively light-insensitive silver halide grains-containing layer of the present invention should have a sensitivity which is so low that it does not substantially contribute to the developed image. The layer may comprise a small amount of silver halide grains with high sensitivity, provided the total resulting sensitivity of this layer is so low that it does not contribute to the resulting image. However, the use of such a layer containing a small amount of sensitive grains may result in somewhat insufficient effects.

The comparatively light-insensitive silver halide emulsion layer of the present invention must have a sensitivity lower than the least sensitive layer of said at least two light-sensitive silver halide emulsion layers of the same color sensitivity by 0.5 or more, preferably, 1.0 or more, in log units.

The comparatively light-insensitive silver halide emulsion of the present invention may be any of pure silver chloride, pure silver bromide, pure silver iodide, silver chlorobromide, silver iodobromide, and silver chloroiodobromide. An emulsion containing 60% or more silver bromide, 30% or less silver chloride, and 40% or less silver iodide is preferable. Grain size of the silver halide is not particularly limited, but a preferable size is 0.6 μm or less, more preferably 0.08 to 0.4 μm. Where the light-insensitive silver halide emulsion-containing layer is provided between blue-sensitive emulsion layers, the size preferably ranges from 0.08 to 0.25 μm. Where the layer is provided between green-sensitive emulsion layers, the size preferably ranges from 0.1 to 0.3 μm and, where provided between red-sensitive emulsion layers, the size preferably ranges from 0.1 to 0.4 μm. The comparatively light-insensitive silver halide emulsion to be used in the present invention may have a comparatively broad grain size distribution, but preferably has a narrow grain size distribution. In particular, 90% by weight or number of silver halide grains preferably have sizes falling within ±40% of an average grain size.

In the silver halide light-sensitive color photographic material comprising a support comprising thereon a red-sensitive silver halide emulsion layer unit, a green-sensitive silver halide emulsion layer unit and a blue-sensitive silver halide emulsion layer unit, wherein said blue-sensitive silver halide emulsion layer unit comprises at least two emulsion layers having the same color sensitivity and being different in sensitivity therein, when the fine grain reflecting layer is provided in at least one of interfaces defined by every two adjacent members of said at least two emulsion layers in said blue-sensitive silver halide emulsion layer unit, the effects of the present invention are remarkably obtained. In the silver halide light-sensitive color photographic material comprising a support comprising thereon a red-sensitive silver halide emulsion layer unit, a green-sensitive silver halide emulsion layer unit and a blue-sensitive silver halide emulsion layer unit, wherein said blue-sensitive silver halide emulsion layer unit comprises three emulsion layers having the same color sensitivity and being different in sensitivity therein, when the fine grain reflecting layer is provided adjacent to and under the emulsion layer having the fastest sensitivity of said three emulsion layer, the effects of the present invention are more remarkably obtained. When the fine grain reflecting layer which provides adjacent to and under the emulsion layer having the fastest sensitivity of said three emulsion layer comprised in the blue-sensitive silver halide emulsion layer unit comprises comparatively light-insensitive silver halide grains of 0.08 to 0.25 μm in average grain size, the effects of the present invention are particularly remarkably obtained.

The comparatively light-insensitive emulsion layer is coated in a silver amount of 0.03 to 5 g/m$^2$, preferably 0.05 to 1 g/m$^2$. The binder for the comparatively light-insensitive layer may be any hydrophilic polymer, with gelatin being preferable. The binder is preferably used in an amount of less than 250 g per mol of silver halide.

The comparatively light-insensitive silver halide to be used in the present invention can be prepared according to known processes, i.e., by any of an acid process, a neutral process, and an ammonia process. Reacting the soluble silver salt with a soluble halide salt may be carried out by any one of single jet mixing, double jet mixing, and combination thereof. A double jet mixing process which involves maintaining the pAg in a liquid phase in which silver halide is produced at a definite level, so-called the controlled double jet process, can be employed. This process provides a narrow grain size distribution, thus being preferable as a process for preparing the comparatively light-insensitive emulsion of the present invention. The grains in the comparatively light-insensitive emulsion may be in a regular crystal form such as cubic, octahedral, dodecahedral or tetradecahedral form or in an irregular crystal form such as spherical or tabular form. The silver halide grains may have an inner portion and a surface layer different form, or the same as, each other in halogen composition. The comparatively light-insensitive emulsion may contain cadmium ion, lead ion, iridium ion, rhodium ion, etc. as impurities. The comparatively light-insensitive emulsion may be of the type which involves forming latent images on the surface of grains or of the type which involves forming latent images within them, with the inner portion of the grains optionally containing fogging nuclei.

The comparatively light-insensitive emulsion may be subjected to ordinary chemical sensitization, i.e., sulfur sensitization, gold sensitization, and reduction sensitization. However, the degree of the chemical sensitization is desirably minimized. Emulsions not subjected to chemical sensitization (so-called primitive emulsions) are preferable used as the emulsions of the present invention.

The comparatively light-insensitive emulsion may contain a cyanine dye, a merocyanine dye, a complex cyanine dye, a complex merocyanine dye, a holopolar cyanine dye, a hemicyanine dye, a styrene dye, a hemioxonol dye, etc. Desensitizing dyes not preferable in ordinary negative emulsions due to large desensitization effect can be used as well. The comparatively light-insensitive emulsion may contain an antifogging agent and a stabilizing agent. For example, such antifogging or stabilizing agents as azoles, hetero ring mercapto compounds, thioketo compounds, azaindenes, benzenethiosulfonic acids, benzenesulfinic acids, etc. can be added.

The comparatively light-insensitive emulsion layer of the present invention may contain dyes and a dispersion of scarcely soluble synthetic polymer.

Silver halide emulsions to be used in the present invention are usually prepared by mixing a solution of a water-soluble silver salt (e.g., silver nitrate) with a solution of a water-soluble halide (e.g., potassium bromide) in the presence of a solution of a water-soluble high polymer such as gelatin. As the silver halides, mixed silver halides such as silver chlorobromide, silver iodobromide, silver chlorobromoiodide, etc. can be used as well as silver chloride and silver bromide. The silver halide grains preferably have an average particle size (particle diameter with respect to spherical or approximately spherical particles, and edge length with cubic particles; presented in terms of an average based on projected area) of 3 μm or less. Particle size distribution can be either narrow or broad.

The silver halide grains may be in a cubic or octahedral form or in a mixed form thereof. Further, separately prepared two or more silver halide photographic emulsions may be mixed for use.

The silver halide grains may have a uniform crystal structure of a layered structure in which the inner portion and the outer portion have different properties, or may be of so-called conversion type as described in British Pat. No. 635,841 and U.S. Pat. No. 3,622,318. In addition, they may be of the type forming a latent image mainly on the surface thereof or of the type forming a latent image within the grains. These photographic emulsions are also described in such books as Mees; *The Theory of Photographic Process* (published by Macmillan), P. Glafkides; *Chimie Photographique* (published by Paul Montel in 1957), etc. and are generally accepted.

The photographic emulsion to be used in the present invention can be prepared by the processes described in P. Glafkides; *Chimie et Physique Photographique* (published by Paul Montel in 1967), G. F. Duffin; *Photographic Emulsion Chemistry* (published by The Focal Press in 1966), V. L. Zelikman et al; *Making and Coating Photographic Emulsion* (published by The Focal Press in 1964), and the like. That is, any of an acid process, a neutral process, and an ammonia process can be used. As a manner of reacting a soluble silver salt with a soluble halide salt, any of single jet mixing, double jet mixing, and their combination may be employed.

A process of forming grains in the presence of excess silver ion (so-called reversal mixing process) can be employed as well. A useful type of double jet mixing process is the controlled double jet process wherein pAg in a liquid phase in which silver halide is formed is kept constant. This process provides a silver halide emulsion containing silver halide grains having a regular crystal form and an approximately uniform particle size.

Two or more silver halide emulsions having been separately prepared may be mixed for use.

During formation or physical ripening of silver halide grains, cadmium salts, zinc salts, lead salts, thallium salts, iridium salts or the complex salts thereof, rhodium salts or the complex salts thereof, iron salts or the complex salts thereof, etc. may be allowed to coexist.

Soluble salts may be removed from the emulsion after forming precipitates or physical ripening, by methods such as a noddle washing method of gelling gelatin or a flocculation method utilizing an inorganic salt composed of a multivalent anion (e.g., sodium sulfate), an anionic surfactant, an anionic polymer (e.g., polystyrenesulfonic acid) or a gelatin derivative (e.g., aliphatically or aromatically acylated gelatin, aromatically carbamoylated gelatin, etc.). The stop of removeing the soluble salts may be omitted.

The silver halide emulsion may be used without chemical sensitization as so-called primitive emulsion, but is usually chemically sensitized. Chemical sensitization can be conducted according to the processes described in the foregoing books written by Glafkides, Zelikman, etc. or in H. Frieser; *Die Grundlagender Photographischen Prozesse mit Silberhalogeniden* (AkademischeVerlagsgesellschaft, 1968).

As a binder or protective colloid to be used in the emulsion layer or interlayer of the light-sensitive material of the present invention, gelatin is advantageously used. However, other hydrophilic colloids can be used as well. For example, proteins such as gelatin derivatives, graft polymers between gelatin and other high polymer, albumin, casein, etc.; cellulose derivatives such as hydroxyethyl cellulose, carboxymethyl cellulose, cellulose sulfate, etc.; sugar derivatives such as sodium alginate, starch derivative, etc.; and various synthetic hydrophilic substances such as homopolymers or copolymers (e.g., polyvinyl alcohol, partially acetalized polyvinyl alcohol, poly-N-vinylpyrrolidone, polyacrylic acid, polymethacrylic acid, polyacrylamide, polyvinyl imidazole, polyvinyl pyrazole, etc.) can be used.

As gelatin, acid-processed gelatin or enzyme-processed gelatin as described in *Bull. Soc. Sci. Photo. Japan,* No. 16, p. 30 (1966) may be used as well as lime-processed gelatin, and a gelatin hydrolyzate or an enzyme-decomposed product can be used. As the gelatin derivatives, those obtained by reacting gelatin with, for example, acid halides, acid anhydrides, isocyanate, bromoacetic acid, alkanesultones, vinylsulfonamides, maleinimide compounds, polyalkylene oxides, epoxy compounds, or the like can be used. Specific examples thereof are described in U.S. Pat. Nos. 2,614,928, 3,132,945, 3,186,846, 3,312,553, British Pat. Nos. 861,414, 1,033,189, 1,005,784, Japanese Patent Publication No. 26845/67, etc.

As the aforesaid gelatin graft polymers, products prepared by grafting to gelatin a homopolymer or copolymer of vinyl monomer such as acrylic acid, methacrylic acid, ester or amide thereof, acrylonitrile, styrene, or the like can be used. In particular, graft polymers between gelatin and a polymer having some compatibility with gelatin such as a polymer of acrylic acid, methacrylic acid, acrylaminde, methacrylamide, hydroxyalkyl methacrylate or the like are preferable. Examples of these are described in U.S. Pat. Nos. 2,763,625, 2,831,767, 2,956,884, etc.

In the present invention, couplers may be used. Usable couplers include the following dye-forming couplers; i.e., compounds capable of forming color by oxidative coupling with an aromatic primary amine developing agent (e.g., a phenylenediamine derivative or an aminophenol derivative) during color development. For example, magenta couplers include 5-pyrazolone couplers, pyrazolobenzimidazole couplers, cyanoacetylcoumarone couplers, open-chain acylacetonitrile couplers, etc., yellow couplers include acylacetamide couplers (e.g., benzolyacetanilides, pivaloylacetanilides, etc.), etc., and cyan couplers include naphthol couplers, phenol couplers, etc. Of these couplers, non-diffusion couplers having a hydrophobic group called ballast group or being converted to polymers are desirable. The couplers may be of either 4-equivalent type or 2-equivalent type with respect to silver ions. In addition, they may be colored couplers having a color-correcting effect or couplers capable of releasing a development inhibitor upon development (called DIR couplers).

In addition to DIR couplers, the colorless DIR coupling compounds which release a development inhibitor and form a colorless coupling reaction product may be incorporated.

In order to obtain properties required for light-sensitive material, two or more of the above-described couplers may be used in one and the same layer, or one and the same compound thereof may of course be incorporated in two or more different layers.

Introduction of the couplers into silver halide emulsion layers is conducted in a known manner, for example, according to the method described in U.S. Pat. No. 2,332,027. For example, the couplers are dissolved in an organic solvent having a high boiling point such as an alkyl phthalate (e.g., dibutyl phthalate, dioctyl phthalate, etc.), a phosphoric ester (e.g., diphenyl phosphate, triphenyl phosphate, tricresyl phosphate, dioctylbutyl phosphate, etc.), a citric acid ester (e.g., tributyl acetylcitrate), a benzoic ester (e.g., octyl benzoate), an alkylamide (e.g., diethyllaurylamide), a fatty acid ester (e.g., dibutoxyethyl succinate, diethyl azelate, etc.), a trimesic acid ester (e.g., tributyl trimesate), etc. or in an organic solvent having a boiling point of about 30° to 150° C. (e.g., lower alkyl acetate such as ethyl acetate or butyl acetate, ethyl propionate, tert-butyl alcohol, methyl isobutyl ketone, β-ethoxyethyl acetate, methyl cellosolve acetate or the like, and dispersed in a hydrophilic colloid. The above-described high-boiling organic solvents and the low-boiling organic solvents may be used in combination.

In addition, a dispersing method using a polymer described in Japanese Patent Publication No. 39853/76 and Japanese Patent Application (OPI) No. 59943/76 can be used.

Couplers with an acid group such as a carboxylic acid or a sulfonic acid are introduced into a hydrophilic colloid as an alkaline aqueous solution.

Photographic color-forming agents to be used are conveniently selected so that they provide an intermediate scale image. The maximum absorption band of a cyan dye formed from the cyan color-forming agent preferably lies between about 600 and about 720 nm, that of a magenta dye between about 500 and about 580 nm, and that of a yellow dye between about 400 and about 480 nm.

The photographic emulsion to be used in the present invention may be spectrally sensitized with methine dyes or the like. Usable dyes include cyanine dyes, merocyanine dyes, complex cyanine dyes, complex merocyanine dyes, holopolar cyanine dyes, hemicyanine dyes, styryl dyes, and hemioxonol dyes. Particulaly useful dyes are those which belong to cyanine dyes, merocyanine dyes, and complex merocyanine dyes. In these dyes, any of nuclei ordinarily used as basic hetero ring nuclei in cyanine dyes can be used. That is, a pyrroline nucleus, an oxazole nucleus, a thiazoline nucleus, a pyrrole nucleus, an oxazole nucleus, a thiazole nucleus, a selenazole nucleus, an imidazole nucleus, a tetrazole nucleus, a pyridine nucleus, etc.; those in which these nuclei are fused with an alicyclic hydrocarbon ring; those in which these nuclei are fused with an aromatic hydrocarbon ring, e.g., an indolenine nucleus, a benzimdolenine nucleus, an indole nucleus, a benzoxazole nucleus, a naphthoxazole nucleus, a benzothiazole nucleus, a naphthothiazole nucleus, a benzoselneazole nucleus, a benzimidazole nucleus, a quinoline nucleus, etc. can be used. These nuclei may be substituted in the nuclear carbon atom.

In the merocyanine dyes or complex merocyanine dyes, 5- or 6-membered hetero ring nuclei such as a pyrazolin-5-one nucleus, a thiohydantoin nucleus, a 2-thiooxazolidin-2,4-dione nucleus, a thiazolidine-2,4-dione nucleus, a rhodanine nucleus, a thiobarbituric acid nucleus, etc. may be used as ketomethylene structure-containing nuclei.

Useful sensitizing dyes include, for example, those described in German Pat. No. 929,080, U.S. Pat. Nos. 2,231,658, 2,493,748, 2,503,776, 2,519,001, 2,912,329, 3,656,959, 3,672,897, 3,694,217, 4,025,349, 4,046,572, British Pat. No. 1,242,588, Japanese Patent Publication Nos. 14030/69 and 24844/77, etc.

These sensitizing dyes may be used alone or in combination. Combinations of sensitizing dyes is often employed particularly for the purpose of supersensitization. Typical examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,836,862, 4,026,707, British Pat. Nos. 1,344,281 and 1,507,803, Japanese Patent Publication Nos. 4936/68 and 12375/78, and Japanese Patent Application (OPI) Nos. 110618/77 and 109925/77.

A dye which itself does not have a spectrally sensitizing effect or a substance which substantially does not absorb visible light and which shows a supersensitization effect may be incorporated together with the sensitizing dye into the emulsion. For example, aminostilbene compounds substituted with a nitrogen-containing hetero ring group (for example, those described in U.S. Pat. Nos. 2,933,390 and 3,635,721), aromatic organic acid-formaldehyde condensates (for example, those described in U.S. Pat. No. 3,743,510), cadmium salts azaindene compounds, etc. may be incorporated. Combinations described in U.S. Pat. Nos. 3,615,613, 3,615,641, 3,617,295, 3,635,721 are particularly useful.

Conventional processes may be applied to the light-sensitive material of the present invention for photographic processing and known processing solutions may be employed for the processing solution of the present invention. The processing temperature is usually selected between 18° and 50° C. However, temperatures lower than 18° C. or higher than 50° C. may be employed. Either a silver image-forming development processing (black-and-white photographic processing) or a color photographic processing composed of a dye image-forming development processing may be applied depending upon the end-use.

A color developing solution generally comprises an alkaline aqueous solution containing a color-developing agent. As the color-developing agent, known primary aromatic amine developing agents such as phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfoamidoethylaniline, 4-amino-3-methyl-N-ethyl-N-β-methoxyethylaniline, etc.) can be used.

In addition, those described in L.F.A. Mason; *Photographic Processing Chemistry* (Focal Press, 1966), pp. 226–229, U.S. Pat. Nos. 2,193,015, 2,592,364, Japanese Patent Application (OPI) No. 64933/73, etc. may also be used.

The color developing solution can further contain pH buffers such as alkali metal sulfites, carbonates, borates, and phosphates, and development inhibitors or anitfoggants such as bromides, iodides, and organic antifoggants. If necessary, water softeners, preservatives such as hydroxylamine, organic solvents such as benzyl alcohol or diethylene glycol, development accelerators such as polyethylene glycol, quaternary ammonium salts or amines, dye-forming couplers, competitive couplers, fogging agents such as sodium borohydride, auxiliary developing agents such as 1-phenyl-3-pyrazolidone, viscosity-imparting agents, polycarboxylic acid series chelating agents described in U.S. Pat. No. 4,083,723, antioxidation agents described in West German Patent Application (OLS) No. 2,622,950, and the like may be contained in the developing solution.

After color development, the photographic emulsion layer is usually bleached. Bleaching processing may be conducted simultaneously with, or separately from, a fixing processing. As a bleaching agent, for example, compounds of polyvalent metals such as iron (III), cobalt (III), chromium (VI), copper (II), etc., peracids, quinones, nitroso compounds, etc. are used. For example, ferricyanides, dichromates, organic complex salts of iron (III) or cobalt (III), complex salts of aminopolycarboxylic acids (e.g., ethylenediaminetetraacetic acid, nitrilotriacetic acid, 1,3-diamino-2-propanoltetraacetic acid, etc.) or organic acids (e.g., citric acid, tartaric acid, malic acid, etc.), persulfates, permanganates, nitrosophenol, etc. can be used. Of these, potassium ferricyanide, iron (III) sodium ethylenediaminetetraacetate, and iron (III) ammonium ethylenediaminetetraacetate are particularly useful. Iron (III) ethylenediaminetetraacetate complex salts are useful in both an independent bleaching solution and a mono-bath bleach-fixing solution.

The bleaching or bleach-fixing solution may contain various additives including bleaching-accelerating agents described in U.S. Pat. Nos. 3,042,520 and 3,241,966, Japanese Patent Publication Nos. 8506/70 and 8836/70, and thiol compounds described in Japanese Patent Application (OPI) No. 65732/78.

The present invention will now be described in more detail by the following non-limiting examples of preferred embodiments of the present invention.

EXAMPLE 1

A multi-layered color light-sensitive material sample comprising a polyethylene terephthalate film support having thereon the following layers of the following formulations was prepared.

1st layer: antihalation layer
A gelatin layer containing black colloidal silver.

2nd layer: interlayer
A gelatin layer containing an emulsion dispersion of 2,5-di-t-octylhydroquinone.

3rd layer: first red-sensitive emulsion layer
Silver iodobromide emulsion (AgI: 5 mol%) . . . coated in a silver amount of 1.6 g/m$^2$)
Sensitizing dye I . . . $6\times10^{-5}$ mol/mol Ag
Sensitizing dye II . . . $1.5\times10^{-5}$ mol/mol Ag
Coupler EX-1 . . . 0.04 mol/mol Ag
Coupler EX-5 . . . 0.003 mol/mol Ag
Coupler EX-6 . . . 0.0006 mol/mol Ag 4th layer: second red-sensitive emulsion layer
Silver iodobromide emulsion (AgI: 7 mol%) . . . coated in a silver amount of 1.4 g/m$^2$
Sensitizing dye I . . . $3\times10^{-5}$ mol/mol Ag
Sensitizing dye II . . . $1.2\times10^{-5}$ mol/mol Ag
Coupler EX-2 . . . 0.02 mol/mol Ag
Coupler EX-5 . . . 0.0016 mol/mol Ag 5th layer: interlayer
the same as the second layer 6th layer: first green-sensitive emulsion layer
Silver iodobromide emulsion (AgI: 4 mol%) . . . coated in a silver amount of 1.2 g/m$^2$
Sensitizing dye III . . . $3\times10^{-5}$ mol/mol Ag
Sensitizing dye IV . . . $1\times10^{-5}$ mol/mol Ag
Coupler EX-4 . . . 0.05 mol/mol Ag
Coupler EX-8 . . . 0.008 mol/mol Ag
Coupler Ex-6 . . . 0.0015 mol/mol Ag 7th layer: second green-sensitive emulsion layer
Silver iodobromide emulsion (AgI: 8 mol%) . . . coated in a silver amount of 1.3 g/m$^2$
Sensitizing dye III . . . $2.5\times10^{-5}$ mol/mol Ag
Sensitizing dye IV . . . $0.8\times10^{-5}$ mol/mol Ag
Coupler EX-10 . . . 0.017 mol/mol Ag
Coupler EX-3 . . . 0.003 mol/mol Ag 8th layer: yellow filter layer
A gelatin layer containing in a gelatin aqueous solution yellow colloidal silver and an emulsion dispersion of 2,5-di-t-octylhydroquinone.

9th layer: first blue-sensitive emulsion layer
Silver iodobromide emulsion (AgI: 6 mol%) . . . coated in a silver amount of 0.7 g/m$^2$
Coupler EX-9 . . . 0.25 mol/mol Ag
Coupler EX-6 . . . 0.015 mol/mol Ag 10th layer: second blue-sensitive emulsion layer
Silver iodobromide emulsion (AgI: 6 mol%) . . . coated in a silver amount of 0.6 g/m$^2$
Coupler EX-9 . . . 0.06 mol/mol Ag 11th layer: first protective layer
Silver iodobromide (AgI: 1 mol%; mean grain size: 0.07$\mu$) . . . coated in a silver amount of 0.05 g/m$^2$
Gelatin layer containing an emulsion dispersion of an ultraviolet ray-absorbing agent, UV-1.

12th layer: second protective layer
A gelatin layer containing trimethylmethanoacrylate particles (diameter: about 1.5$\mu$) was coated.

A gelatin hardener, H-1, and a surfactant were added to each of the above-described layers in addition to the above-described formulations. The thus prepared sample was referred to as sample 101.

Compounds used for preparing sample 101:
Sensitizing dye I: anhydro-5,5'-dichloro-3,3'-di-($\gamma$-sulfopropyl)-9-ethyl-thiacarbocyanine hydroxide pyridinium salt
Sensitizing dye II; anhydro-9-ethyl-3,3'-di-($\gamma$-sulfopropyl)-4,5,4',5'-dibenzothiacarbocyanine hydroxide triethylamine salt
Sensitizing dye III: anhydro-9-ethyl-5,5'-dichloro-3,3'-di($\gamma$-sulfopropyl)oxacarbocyanine sodium salt
Sensitizing dye IV: anhydro-5,6,5',6'-tetrachloro-1,1'-diethyl-3,3'-di-{$\beta$-[$\beta$($\gamma$-sulfopropyl)ethoxy]ethylimidazolocarbocyanine hydroxide sodium salt Coupler EX-1

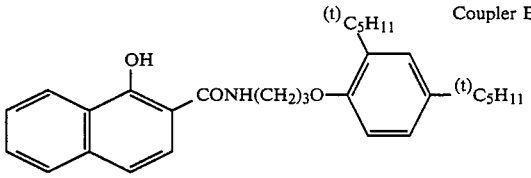

Coupler EX-2

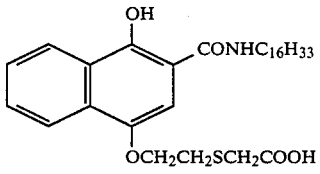

-continued
Coupler EX-3
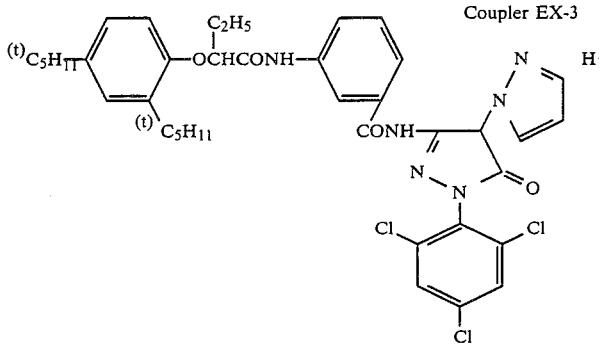
EX-4
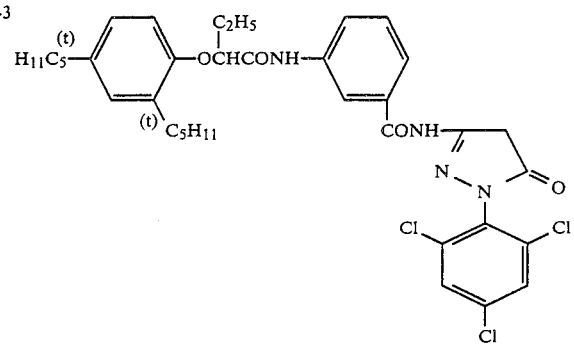
EX-5
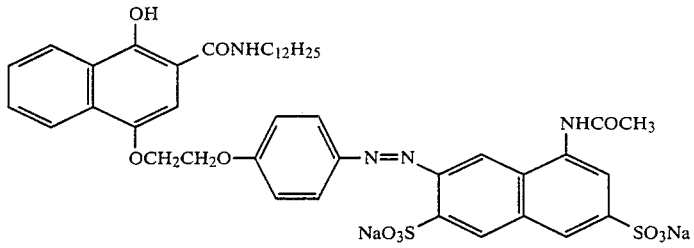
EX-6
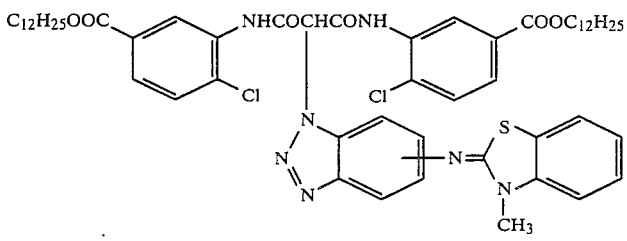
EX-7
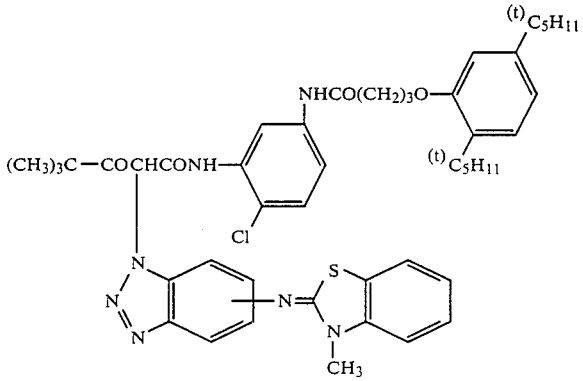
EX-8
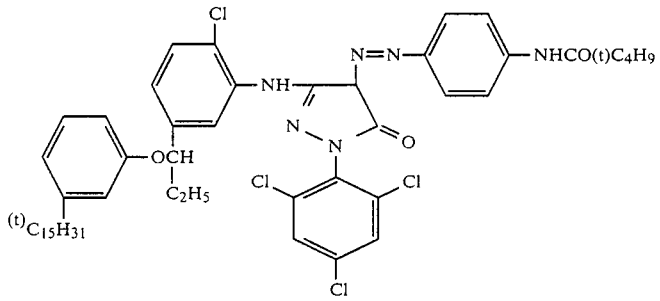

-continued

EX-9

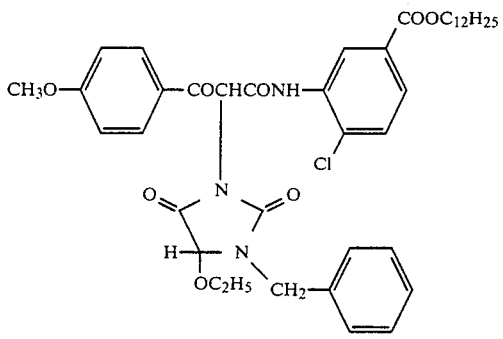

EX-10

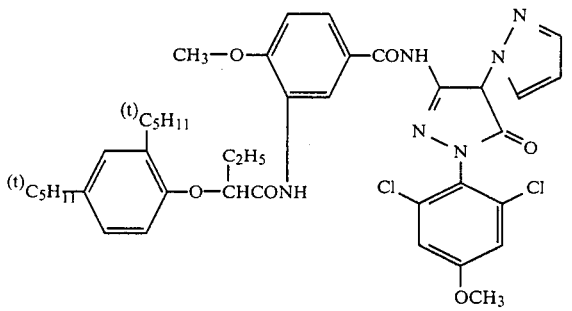

H-1

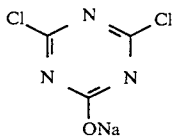

A primitive silver iodobromide emulsion (AgI: 2 mol%) of 0.25 μm in average grain size was prepared according to a double jet process in which pAg was controlled upon addition. Sample 102 in which a light-insensitive layer (NS) containing 0.75 g/m$^2$ of the above-described emulsion was provided between the 8th layer and the 9th layer of sample 101, and sample 103 in which the NS layer was provided between the 9th layer and the 10th layer were prepared.

Sample 104 was prepared in the same manner as with sample 101 except for providing a 9'th layer of the following formulation in place of the 9th layer and the 10th layer.

Sample 105 in which the foregoing light-insensitive emulsion was provided between the 8th layer and the 9'th layer of sample 104 was prepared.

9'th layer: blue-sensitive emulsion layer

Silver iodobromide emulsion (AgI: 6 mol%; average grain size: 0.7μ) . . . coated in a silver amount of 2.6 g/m$^2$ The emulsion used herein had a grain size distribution controlled so that it possesses the same sensitivity gradation as that of the blue-sensitive emulsion layers of sample 101.

Sample 106 was prepared in the same manner as with sample 103 except for providing a light-insensitive layer (NS') between the 9th layer and the 10th layer of sample 103 in place of the light-insensitive layer of sample 103.

NS' layer:

Primitive silver iodobromide emulsion used in NS layer . . . 0.75 g/m$^2$

Coupler EX-9 . . . $2.0\times10^{-4}$ mol/m$^2$

Each of the thus prepared samples 101 to 106 was exposed through a filter having stepwise changing densities, then subjected to the following development processing. The following processing was conducted at 38° C.

| | | |
|---|---|---|
| 1. | Color development | 3 min. & 15 sec. |
| 2. | Bleaching | 6 min. & 30 sec. |
| 3. | Washing with water | 3 min. & 15 sec. |
| 4. | Fixing | 6 min. & 30 sec. |
| 5. | Washing with water | 3 min. & 15 sec. |
| 6. | Stabilizing | 3 min. & 15 sec. |

Formulations of the processing solutions used in the above-described steps are as follows.

| | |
|---|---|
| Color developing solution | |
| Sodium nitrilotriacetate | 1.0 g |
| Sodium sulfite | 4.0 g |
| Sodium carbonate | 30.0 g |
| Potassium bromide | 1.4 g |
| Hydroxylamine sulfate | 2.4 g |
| 4-(N—Ethyl-N—β-hydroxyethylamino)-2-methylaniline sulfate | 4.5 g |
| Water to make | 1 liter |
| Bleaching solution | |
| Ammonium bromide | 160.0 g |
| Aqueous ammonia (28%) | 25.0 ml |
| Sodium iron ethylenediaminetetraacetate | 130.0 g |
| Glacial acetic acid | 14.0 ml |
| Water to make | 1 liter |
| Fixing solution | |
| Sodium tetrapolyphosphate | 2.0 g |
| Sodium sulfite | 4.0 g |
| Ammonium thiosulfate (70%) | 175.0 ml |
| Sodium bisulfite | 4.6 g |
| Water to make | 1 liter |
| Fixing solution | |
| Formalin | 8.0 ml |
| Water to make | 1 liter |

Sensitivities and graininesses of the yellow images of the samples thus formed were measured. Graininess was measured according to conventional RMS method. The aperture for the measurement was 48μ.

| Sample No. | Sensitivity (Relative) | Graininess (RMS Values At A Density of 2.0) |
|---|---|---|
| 101 (*) | 100 | 0.030 |
| 102 (*) | 150 | 0.044 |
| 103 (**) | 180 | 0.022 |
| 104 (*) | 100 | 0.045 |
| 105 (*) | 150 | 0.056 |
| 106 (**) | 130 | 0.038 |

(*) comparative example
(**) present invention

As is clear from the above table, sample 103 in which a light-insensitive emulsion layer was provided between a more sensitive emulsion layer and a less sensitive emulsion layer showed rather improved graininess despite the fact that the sensitivity was almost doubled. In comparison with sample 102 in which a light-insensitive layer was provided under a less sensitive emulsion layer, sample 103 provides excellent results in that its sensitivity and graininess are simultaneously improved. In addition, in comparison with the sample which had one blue-sensitive layer, the layer structure of the present invention proved to show specific effects with respect to sensitivity and graininess.

Samples having couplers in the light-insensitive layer showed less sensitivity and less graininess than those having no couplers. Therefore, it is seen that the use of a coupler-free, light-insensitive emulsion layer is advantageous because it provides great effects of the present invention.

EXAMPLE 2

Primitive silver bromide emulsions of 0.05, 0.14, 0.23, 0.45, 0.72, and 0.97 μm in average grain size were prepared as follows.

A silver nitrate aqueous solution and a potassium bromide aqueous solution were simultaneously added to a gelatin aqueous solution kept at a definite temperature, during which the pAg in the reactor tank was kept at 7.9, to prepare a cubic silver bromide grains emulsion. By changing the adding time of the silver nitrate aqueous solution and the potassium bromide aqueous solution and changing the temperature of the reaction tank, six emulsions having grain sizes of 0.05 μm, 0.14 μm, 0.24 μm, 0.45 μm, 0.72 μm, and 0.97 μm, respectively, were prepared.

Samples 202 to 207 were prepared in the same manner as with sample 101 except for providing a light-insensitive emulsion layer containing 0.26 g/m$^2$ of each of these emulsions between the 9th layer and the 10th layer of Example 1.

These samples 202 to 207 and sample 101 were exposed and developed in the same manner as in Example 1. Sensitivities and graininesses of formed yellow images of the samples were measured in the same manner as in Example 1.

Results thus obtained are tabulated in Table 2.

TABLE 2

| Sample No. | Grain Size of Light-insensitive Emulsion Layer | Relative Sensitivity | Graininess |
|---|---|---|---|
| 101 (control) | — | 100 | 0.030 |
| 202 (*) | 0.05 | 115 | 0.030 |
| 203 (*) | 0.14 | 125 | 0.028 |
| 204 (*) | 0.23 | 130 | 0.026 |
| 205 (*) | 0.45 | 118 | 0.025 |
| 206 (**) | 0.72 | 100 | 0.025 |
| 207 (**) | 0.97 | 95 | 0.025 |

(*) present invention
(**) comparative example

As is clear from Table 2, samples 202, 203, 204, and 205 in accordance with the present invention having grain sizes of 0.05, 0.14, 0.23, and 0.45 μm, respectively, showed increased sensitivities and tended to show improved graininesses. However, samples 206 and 207 did not show an increase in sensitivity. Thus, application of the present invention proved to be effective.

EXAMPLE 3

Sample 301 was prepared in the same manner as with sample 101 in Example 1 except for providing a first blue-sensitive emulsion layer having slower sensitivity (which refers to a 9S layer) and a first blue-sensitive emulsion layer having faster sensitivity (which refers to a 9F layer) according to the following formulations in place of a first blue-sensitive emulsion layer (i.e., a 9th layer).

9S layer: first blue-sensitive emulsion layer having slower sensitivity
- Silver iodobromide emulsion (Ag I: 4 mol%) . . . coated in a silver amount of 0.5 g/m$^2$
- Coupler EX-9 . . . 0.30 mol/mol Ag
- Coupler EX-6 . . . 0.025 mol/mol Ag 9F layer: first blue-sensitive emulsion layer having faster sensitivity
- Silver iodobromide emulsion (AgI: 6 mol%) . . . coated in a silver amount of 0.25 g/m$^2$
- Coupler EX-9 . . . 0.17 mol/mol Ag
- Coupler EX-6 . . . 0.010 mol/mol Ag A primitive silver iodobromide emulsion of 0.15 μm in average grain size was prepared according to the following process. A silver nitrate aqueous solution and an aqueous solution containing a mixture of 98 mol% of potassium bromide and 2 mol% of potassium iodide based on mol of silver halides were simultaneously added to a gelatin aqueous solution in reactor tank, while keeping the pAg of mixture in reactor tank at 7.9 and the temperature of mixture at 50° C. consequently to obtain emulsion containing cubic silver iodobromide particles. The average grain size was 0.15 μm. Sample 302 in which a light-sensitive layer containing 0.30 g/m$^2$ of the above-described emulsion was provided between the 8th layer and the 9S layer, sample 303 in which the light-insensitive layer was provided between the 9S layer and the 9F layer and sample 304 in which the light-insensitive layer was provided between the 9F layer and the 10th layer were prepared.

These samples 301 to 304 were exposed and developed in the same manner as in Example 1. Sensitivities and graininess of formed yellow images of the samples were measured in the same manner as in Example 1.

Results thus obtained are tabulated in Table 3.

TABLE 3

| Sample No. | Relative Sensitivity | Graininess (The RMS Value at a Density of 2.0) |
|---|---|---|
| 301 (**) | 100 | 0.030 |
| 302 (**) | 100 | 0.031 |
| 303 (*) | 118 | 0.029 |
| 304 (*) | 132 | 0.026 |

(*) present invention
(**) comparative example

As is clear from Table 3, samples 303 and 304 in accordance with the present invention showed both an improved graininess and a raised sensitivity as compared with sample 301 wherein no light-insensitive layer was provided and sample 302 wherein a light-insensitive layer was provided adjacent to and under the least-sensitive emulsion layer (i.e., the 9S layer).

Further, the light-insensitive emulsion of Example 3 alone was coated on a support and the sensitivity of the thus obtained emulsion layer was measured. It was confirmed that the light-insensitive emulsion layer had a sensitivity lower than the least-sensitive emulsion layer (i.e., the 9S layer) by at least 3.5 in log unit.

While the invention has been described in detail and with reference to specific embodiments thereof, it will be apparent to one skilled in the art that various changes and modifications can be made therein without departing from the spirit and scope thereof.

What is claimed is:

1. A silver halide light-sensitive material comprising a support comprising thereon (1) at least two emulsion layers having the same color sensitivity and being different in sensitivity, and (2) an intermediate layer sandwiched between said at least two emulsion layers, said intermediate layer containing comparatively light-insensitive silver halide grains of 0.05 to 0.6 μm in average grain size and wherein said intermediate layer does not contain couplers and has a sensitivity lower than the least sensitive layer of the two light-sensitive silver halide emulsion layers of the same color sensitivity by 0.5 or more log units.

2. A silver halide light-sensitive material as claimed in claim 1, wherein the layer containing comparatively light-insensitive silver halide grains has a sensitivity lower than the least sensitive layer of at least two light sensitive silver halide emulsion layers of the same color sensitivity by 1.0 or more in log units.

3. A silver halide light-sensitive material as claimed in claim 1, wherein the layer containing comparatively light-insensitive silver halide grains is comprised of an emulsion containing 60% or more silver bromide, 30% or less silver chloride, and 40% or less silver iodide.

4. A silver halide light-sensitive material as claimed in claim 1, wherein the light-insensitive silver halide grains have a size in the range of 0.08 to 0.4 μm.

5. A silver halide light-sensitive material as claimed in claim 1, wherein said at least two emulsion layers are blue-sensitive emulsion layers and the light-insensitive layer includes silver halide grains having a size in the range of 0.08 to 0.25 μm.

6. A silver halide light-sensitive material as claimed in claim 1, wherein said at least two emulsion layers are green-sensitive silver halide emulsion layers and the light-insensitive silver halide grains have a size in the range of 0.1 to 0.3 μm.

7. A silver halide light-sensitive material as claimed in claim 1, wherein said at least two emulsion layers are red-sensitive silver halide emulsion layers and the light-insensitive silver halide grains have a size in the range of 0.1 to 0.4 μm.

8. A silver halide light-sensitive material as claimed in claim 1, wherein the layer containing comparatively light-insensitive silver halide grains is present in an amount in the range of 0.03 to 5 $g/m^2$ based on the amount of silver.

9. A silver halide light-sensitive material as claimed in claim 8, wherein the layer containing comparatively light-insensitive silver halide grains is present in an amount in the range of 0.05 to 1 $g/m^2$ based on the amount of silver.

* * * * *